United States Patent [19]

Maekawa et al.

[11] Patent Number: 4,490,732

[45] Date of Patent: Dec. 25, 1984

[54] HEAT-SENSITIVE RECORDING SHEETS

[75] Inventors: Masakazu Maekawa; Yasuhiro Ogata, both of Shizuoka, Japan

[73] Assignee: Fuji Photo Film Co., Ltd., Kanagawa, Japan

[21] Appl. No.: 436,083

[22] Filed: Oct. 22, 1982

[30] Foreign Application Priority Data

Oct. 22, 1981 [JP] Japan ..... 56/169035

[51] Int. Cl.[3] ..... B41M 5/22

[52] U.S. Cl. ..... 346/200; 346/207; 346/226; 428/409; 428/537.5

[58] Field of Search ..... 282/27.5; 427/150–153; 428/211, 320.8, 409, 411, 488, 537, 913, 914

[56] References Cited

U.S. PATENT DOCUMENTS 4,032,690 6/1977 Kohmura et al. ..... 428/537

4,098,114 7/1978 Asao et al. ..... 428/914

*Primary Examiner*—Bruce H. Hess

*Attorney, Agent, or Firm*—Sughrue, Mion, Zinn, Macpeak and Seas

[57] ABSTRACT

A heat-sensitive recording sheet is disclosed. The sheet comprises a base paper and a heat-sensitive color forming layer on the base paper, wherein the base paper has a density of 0.9 g/cm$^3$ or less and its surface on which the heat-sensitive color forming layer is to be coated has an optical contact ratio of at least 15%.

8 Claims, No Drawings

HEAT-SENSITIVE RECORDING SHEETS

FIELD OF THE INVENTION

The present invention relates to heat-sensitive recording sheets which can create an image in combination with a thermal head or a thermal pen and, more particularly, to heat-sensitive recording sheets which are free from problems such as sticking of a heat-sensitive color forming layer to a thermal head and piling of the fused material of the heat-sensitive color forming layer on a thermal head and which can provide clear high-density images even by high-speed recording.

BACKGROUND OF THE INVENTION

In recent years, devices such as facsimile systems and printers have undergone a marked development. In particular, such devices have been modified to utilize a heat-sensitive recording system including the combination of a heat-sensitive recording sheet and a thermal head, said recording sheet being coated with a colorless dye such as Crystal Violet lactone and a phenol compound. For example, the system described in Japanese Pat. Publication No. 14039/70 (British Pat. No. 1,135,540) is widely used in such devices.

This heat-sensitive recording system has many advantages, e.g., since the recording sheet involves first order color formation, no development is needed and a recording apparatus can be simplified. Furthermore, the production costs of the recording sheet and the recording apparatus are low, and there are no noise problems because the recording system is of the nonimpact type. Thus, the system has attained a position as a low-speed recording system in the recording technology.

The heat-sensitive recording system, however, suffers from the serious disadvantage that the recording speed is low compared with other recording systems such as electrostatic recording system. Therefore, it is not employed in high-speed recording.

The major factor preventing high-speed recording with a heat-sensitive recording system is insufficient heat conduction between a thermal head and a heat-sensitive recording sheet coming into contact with the thermal head. Because of the insufficient heat conduction, sufficient recording density cannot be obtained. The thermal head comprising an assembly of dot-like electric resistance heating elements generates heat on application of recording signals and melts the heat-sensitive color forming layer in contact therewith, thereby causing it to form color therein. In order to obtain sharp and high density recording, it is required that dot reproducibility is high. More specifically, the thermal head and the heat-sensitive color forming layer come into contact as closely as possible so that the heat conductivity is achieved efficiently and completely colored dot patterns corresponding to the dot heating elements of the thermal head are formed in the heat-sensitive color forming layer exactly according to high-speed recording signals. At present, however, only several percents of the heat generated from the thermal head is transferred to the heat-sensitive color forming layer. Accordingly, the efficiency of heat conductivity is extremely low.

In order to overcome the problem, several methods of increasing the smoothness of the heat-sensitive color forming layer have been proposed. Increasing smoothness is done in order to bring the thermal head and the heat-sensitive color forming layer into as close a contact as possible.

Japanese Patent Publication No. 20142/77 describes a method in which the heat-sensitive color forming layer is subjected to a surface treatment to the extent that the Bekk smoothness is from 200 to 1,000 seconds. Japanese Patent Application (OPI) No. 15255/79 (the term "OPI" as used herein refers to a "published unexamined Japanese patent application") describes that the heat-sensitive color forming layer subjected to a surface treatment to the extent that the Bekk smoothness is from 200 to 1,000 seconds can respond only to thermal pulses of about 5 to 6 milliseconds. Accordingly, it is necessary in high-speed recording utilizing heat pulses of 1 millisecond or less that the heat-sensitive color forming layer is subjected to a surface treatment to the extent that the Bekk smoothness is at least 1,100 seconds. IF the Bekk smoothness of the heat-sensitive layer is made higher than 1,100 seconds by pressing the heat-sensitive recording paper, color fogging is formed by pressure. However, after the heat-sensitive recording layer is coated on the base paper increasing the smoothness to the Bekk smoothness above 500 seconds, if the Bekk smoothness is increased above 1,100 seconds by adjusting the surface of the heat-sensitive recording paper, the resulting recording paper can give high recording density without increasing fog formation. In Japanese Patent Application (OPI) No. 156086/80 (British Pat. No. 2,051,391), it is described that the surface roughness Ra and gloss of the surface of a heat-sensitive color forming layer are made 1.2 $\mu$m or less and 25% or less, respectively.

In accordance with conventional techniques, the smoothness of the heat-sensitive color forming layer has been increased only by calender treatment such as super calendering, machine calendering, and gloss calendering. Such calender treatments are only applied to the base paper, or the base paper and the heat-sensitive recording sheet, or only to the heat-sensitive sheet. With heat-sensitive recording sheets improved in smoothness by the above-described calender treatments, as the recording density is increased by increasing the smoothness, sticking and piling occur more frequently. In practice, therefore, the recording density and the occurrence of such sticking and piling are balanced appropriately by controlling the smoothness to a suitable level. Thus, even if the smoothness is adjusted to any level by the conventional methods, the resulting heat-sensitive recording sheet is not suitable for use in high-speed recording with respect to recording density or record stability.

The sticking phenomenon is created when the thermal head sticks to the heat-sensitive color forming layer, producing a peeling noise and reducing dot reproducibility. The piling phenomenon is created when the heat-melted product (fused material) of the heat-sensitive color forming layer is deposited on the thermal head, reducing the recording density and dot reproducibility. They are both phenomena interfering with stable recording.

Another disadvantage of the calender treatment is that colored fog is formed by pressure, resulting in an increase in density of the background of the recording sheet.

Furthermore, even if the smoothness is increased to, for example, a Bekk smoothness of at least 1,000 seconds by super calendering, the recording density is not always increased. In some cases, the fine unevenness in basis weight is enhanced and the close contact between the heat-sensitive color forming layer and the thermal head is reduced and, therefore, the recording density drops below the maximum value.

When the smoothness is increased by subjecting the base paper or heat-sensitive recording sheet to calender treatments, the thickness of the resulting heat-sensitive recording sheet is reduced, and the density of the heat-sensitive color forming layer and the base paper is increased. This means that the void contents of the heat-sensitive color forming layer and the base paper layer adjacent to the heat-sensitive color forming layer are reduced. Although the heat conductivity of the heat-sensitive color forming layer is slightly improved, it is believed that substances heat-melted in recording are prevented from permeating from the surface of the heat-sensitive color forming layer through the heat-sensitive color forming layer and the base paper layer adjacent thereto into the interior of the heat-sensitive recording sheet. Therefore, the heat-melted substances remain mainly on the surface of the heat-sensitive color forming layer, causing sticking of the heat-sensitive color forming layer and piling on the thermal head.

Increasing the smoothness of the heat-sensitive color forming layer and the recording density by calender treatments inevitably leads to sticking, piling, and colored fog. It is, therefore, difficult to satisfy the both at the same time. At present, therefore, the sticking and piling are reduced and emphasis is placed on the stable recording performance. Accordingly, sufficient recording density cannot be obtained by high-speed recording.

SUMMARY OF THE INVENTION

A primary object of the invention is to provide a heat-sensitive recording sheet which permits the reproduction of sharp and high density images at high speeds without causing sticking and piling.

As a result of extensive investigations based on the findings that the smoothness of the base paper for use in the preparation of a heat-sensitive recording sheet is very important for the production of a heat-sensitive recording sheet which produces sharp and high density images, it has been found that heat-sensitive recording sheets very suitable for high-speed recording can be obtained by using a base paper having a density of 0.9 g/cm$^3$ or less and an optical contact ratio of at least 15%.

The present invention, therefore, relates to a heat-sensitive recording sheet comprising a base paper and a heat-sensitive color forming layer on the base paper wherein the base paper has a density of 0.9 g/cm$^3$ or less and its surface on which the heat-sensitive color forming layer is to be coated has an optical contact ratio of at least 15%.

DETAILED DESCRIPTION OF THE INVENTION

The term "optical contact ratio" as used in this specification is a contact rate, as determined optically, between paper and a prism which have been brought into close contact with each other under pressure. In view of the principle, it is believed that the optical contact ratio is a suitable measure of indicating the extent of the close contact between a thermal head and heat-sensitive recording sheet.

The principle of measurement is described in Shinpei Inamoto, *Measuring Method of Printing Smoothness of Paper Mainly by Optical Contact Method,* Ministry of Finance, Printing Bureau, Report, Vol. 29, No. 9, pages 615 to 622 (September, 1977). The measurement apparatus may be a dynamic printing smoothness measuring apparatus (produced by Toyo Seiki Seisakusho, K.K.). The optical contact ratio as used herein is a value as determined by bringing a prism into close contact with paper at a pressure of 15 kg/cm$^2$ and, 10 milliseconds after pressing, measuring the contact ratio therebetween at a wavelength of 0.5 $\mu$m.

The base paper as used herein has a density of 0.9 g/cm$^3$ or less, preferably 0.65 to 0.90 g/cm$^3$, and an optical contact ratio of at least 15%, preferably 15 to 50%, said optical contact ratio being the one of the surface on which a heat-sensitive color forming layer is to be coated.

Such a base paper is obtained by drying a wet paper after pressing or by drying a paper impregnated with water by pressing the paper onto the smooth surface of a metal. In accordance with such methods, a base paper having a large optical contact ratio can be obtained without increasing the density as with a calender treatment. In accordance with the most preferred production method, a wet web having a water content of 50 to 70% after being press prepared using a paper manufacturing machine having a Yankee dryer is dried to a water content of 15% or less by pressing the paper onto the Yankee dryer. Even when a base paper having an optical contact ratio of 15% or less is prepared by a paper machine having a multi-cylinder dryer, the base paper is coated or impregnated with water to increase the water content above 20% and the paper may be dried to a water content of 15% or less by pressing the wetted paper onto a Yankee dryer.

In order to further increase the optical contact ratio of the base paper, a liquid composed of a pigment and a polymer binder may be coated on or sprayed onto the paper before pressing the paper onto a Yankee dryer.

Even if the optical contact ratio of a base paper is large, the optical contact ratio is reduced greatly by coating and hence the use of a base paper having a large optical contact ratio is meaningless. However, with a base paper of this invention, the reduction in optical contact ratio by coating is less. Therefore, heat-sensitive recording paper having a large optical contact ratio is obtained without increasing the density by using the base paper.

One criterion for reducing the optical contact ratio by coating an aqueous coating composition is the water expansion of the base paper when immersed in water. Base paper dried by a Yankee dryer showed a very low water expansion of cross direction of 2.5% or less and the reduction in optical contact ratio of the base paper by drying shrinkage after coating is less. Therefore, a heat-sensitive recording paper having a heat-sensitive color forming layer with a large optical contact ratio is obtained without requiring a strong calender treatment. On the other hand, an ordinary base paper dried by a multi-cylinder dryer shows a large water expansion of cross direction of 3 to 6%, shows a large reduction in optical contact ratio by coating, and requires a strong calender treatment, thereby increasing the density, sticking and piling. Furthermore, a heat-sensitive recording paper prepared by using a base paper showing small water expansion shows less shrinkage of the surface of the base paper which is in contact with the heat-sensitive color forming layer by heating at recording and shows good contact with a thermal head during recording. The water expansion is a value measured by the method of J-TAPPI No. 27m. Base paper dried by pressing onto a Yankee dryer is effective in this invention because of having very high optical contact ratio and large void content. For example, the void content of a base paper of this invention having an optical contact ratio of 26.1% is 50% but the void content of a base paper having an optical contact ratio of 21.8% dried by a multi-cylinder dryer and super-calendered is 37%.

The void content of a paper is calculated by the following equation.

$$\text{Void content} = 1 - (A/B)$$

A: Apparent density of a paper

B: True density of the paper

The apparent density is calculated from the basis weight and the measured value of thickness by JIS P-8118. The density is assumed to be 1.5. A large void content of a base paper shows that the base paper which is in contact with a heat-sensitive color forming layer absorbs a substantial amount of the fused matter of the heat-sensitive color forming layer with heating, thereby sticking and piling are reluctant to occur. In order to obtain a high recording density with a heat-sensitive recording sheet using usual base paper dried by a multi-cylinder dryers, it is necessary to first subject the base paper to a calender treatment. The calendering treatment is not preferred because of making the density of the base paper to higher than 0.9 g/cm$^3$. However, by using a base paper having a density of 0.9 g/cm$^3$ or less and a high optical contact ratio, a heat-sensitive recording paper having higher recording density can be obtained.

By using a base paper of this invention having a void content of 40% or more, a density of 0.9 g/cm$^3$ or less, and an optical contact ratio of 15% or more, the heat-sensitive recording paper will produce a high density image and not cause sticking and piling. The air permeability and oil absorption of the base paper also affect the fused material absorptive faculty of the base paper, that is, the sticking and piling preventing faculty. In such a base paper, the optical contact ratio is 15% or more, the air permeability is low, and the value as obtained by dividing the air permeability (sec) by a basis weight (g/m$^2$) is 2 or less. In the case of a base paper as prepared by drying by means of a multi-cylinder dryer and subjecting to super calendering, and having an optical contact ratio of 21.8% and a density of 0.95 g/cm$^3$, the value is 2.5.

The oil absorption is 300 seconds or less for the base paper of the invention, but 380 seconds for the above-described super calendered base paper.

The base paper of the invention has low air permeability and oil absorption although its optical contact ratio is high. This demonstrates that the base paper has an excellent ability to prevent sticking and piling.

The air permeability is measured by JIS P-8117 (Japanese Industrial Standard), and the oil absorption is measured by JIS P-8130 (1963) (Japanese Industrial Standard).

A base paper of the invention, having an optical contact ratio of 26.1% has a Bekk smoothness of 100 seconds or less, and a heat-sensitive recording sheet as prepared using the base paper has a Bekk smoothness as low as 200 seconds or less. The heat-sensitive recording sheet, however, provides higher recording densities at high-speed recording than a heat-sensitive recording sheet as prepared using a base paper (Bekk smoothness, 720 seconds) produced by a multi-cylinder dryer and having a Bekk smoothness of 900 seconds. This shows that the Bekk smoothness is not always a measure of recording density.

Enhancing beating of pulp is an example of one method for improving the smoothness of a base paper and improving the smoothness of a heat-sensitive recording paper. For example, Japanese Patent Application (OPI) No. 24191/81 describes that a paper having a density above 0.9 g/cm$^3$ using a pulp having a Canadian standard freeness below 250 cc is used as the base paper. However, the enhancing of beating increases the density of the base paper and reduces the void content, which are undesirable for the invention in view of preventing sticking and piling. The base paper provided with a smoothness dried by pressing onto a Yankee dryer has a Canadian standard freeness above 250 cc but a preferred Canadian standard freeness for obtaining a sufficient smoothness is about 300 to 400 cc. When increasing the void content, a base paper having an optical contact ratio above 15% is obtained even if the Canadian standard freeness is 400 cc to the state of unbeaten.

If the optical contact ratio of a base paper is 15% or more, a heat-sensitive recording paper shows a higher recording density and excellent running property for recording as compared to the case of using a conventional base paper dried by a multi-cylinder dryer. When a high recording density at high-speed recording is required, it is preferred to use a base paper having an optical contact ratio of at least 20%. More preferably, a base paper having an optical contact ratio of at least 25% is used. Such a base paper is prepared using a wood pulp such as NBKP, LBKP, NBSP, LBSP, etc. Also, it is possible to increase the void content of a base paper by using a mixture of the foregoing wood pulp and a synthetic pulp.

When producing the base paper, a filler such as clay, talc, calcium carbonate or urea resin particles; a sizing agent such as rosin, alkenylsuccinic acid, alkylketene dimer or a petroleum resin; and a fixing agent such as aluminum sulfate or a cationic polymer may be added to the pulp. Also, a pigment such as calcium carbonate or synthetic aluminum silicate; a polymer adhesive such as starch, polyvinyl alcohol or a SBR latex may be coated on the base paper by a size press in a range not exceeding 2 in the value of the air permeability divided by the basis weight and 300 sec. in the oil absorption.

Furthermore, the back surface of a base paper may be coated with a coating composition for curling prevention or preventing the heat-sensitive color forming layer from being changed with the passage of time.

A base paper containing no sizing agent and having a Stökigt sizing degree of 0 second can be used as the base paper in this invention. However, it is preferred to impart a sizing degree (of Cobb Test) of 15 to 25 g/m$^2$ by adding a sizing agent into the paper. The base paper pressed and dried by a Yankee dryer may be further treated by a super calender, a machine calender, or a gloss calender, to increase its optical contact ratio. There can be obtained a base paper which has a high optical contact ratio even though its density is low, as compared with a base paper as prepared by a multi-cylinder dryer drying.

The heat-sensitive coating solution as used herein is a coating solution as prepared by dispersing fine particles of heat-sensitive color forming material in water as a dispersion medium. In more detail, electron donating colorless dyes such as Crystal Violet lactone and electron accepting compounds such as 2,2-bis-(4-hydroxyphenyl)propane are dispersed in an aqueous polyvinyl alcohol solution as fine particles having a grain size of less than several microns to prepare such coating solutions. Methods of preparing such coating solutions are described in, for example, U.S. Pat. No. 4,255,491, Japanese Patent Publication No. 14039/70 and Japanese Patent Application (OPI) No. 93492/80. Dispersed particles contained in the heat-sensitive coating solution are preferably such that the volume-average particle size is 8 μm or less, preferably 4 μm or less. The reason for this is that the heat-sensitive color forming layer is generally coated in a thickness of from 5 to 10 μm and, therefore, if coarse particles are contained in the coating solution, sufficient smoothness cannot be obtained even by using the base paper of the invention.

Some of the major advantages of the invention are given below:

(1) Since a base paper having a high optical contact ratio is used in the invention, there can be obtained a heat-sensitive recording sheet which has a heat-sensitive color forming layer capable of being kept in close contact with a thermal head and which provides sharp and high density recording even during high-speed recording.

(2) Since a base paper having a high optical contact ratio is used in the invention, it is not necessary to make the base paper and/or heat-sensitive recording sheet smooth by applying calendering under severe conditions. This increases the void content of the base paper layer and/or heat-sensitive color forming layer. Therefore, there can be obtained a heat-sensitive recording sheet which is free from sticking, piling, and colored fog although its recording density is high.

(3) A Yankee dryer drying method as used in the production of a base paper having a high optical contact ratio lowers the water expansion of the base paper and reduces the reduction in the optical contact ratio during coating or heat-recording. Therefore, there can be obtained a heat-sensitive recording sheet having a heat-sensitive color forming layer having good contacting properties to a thermal head.

The following examples are given to illustrate the invention in greater detail. However, the invention is not limited to these examples. In the examples, all parts and percentages are by weight unless otherwise indicated.

EXAMPLE 1

LBKP (100 parts) was beaten to a Canadian standard freeness of 350 cc, and 1 part of rosin and 2 parts of aluminum sulfate were added to the pulp. The mixture was processed by the use of a Fourdrinier paper machine to produce a base paper having a basis weight of about 50 g/m$^2$. The wire side of the wet paper which had passed through a pressing portion was pressed onto a Yankee dryer having a surface temperature of 120° C. and dried to a water content of 8%. The paper was then subjected to machine calendering.

EXAMPLE 2

The Yankee dried-pressed surface of a base paper as produced in the same manner as in Example 1, on which a heat-sensitive coating solution was to be coated, was coated with a coating solution composed of 100 parts of calcium carbonate, 50 parts of oxidized starch and 225 parts of water by means of a Bill blade coater in an amount (solids) of 2 g/m$^2$. It was then again pressed onto the Yankee dryer, dried to a water content of 8%, and subjected to machine calendering.

COMPARATIVE EXAMPLE 1

LBKP (100 parts) was beaten to a Canadian standard freeness of 350 cc, and 1 part of rosin and 2 parts of aluminum sulfate were added to the pulp. The mixture was processed by the use of a Fourdrinier paper machine to produce a base paper having a basis weight of about 50 g/m$^2$. The wet web which had passed through the pressing portion was dried to a water content of 8% by means of a multi-cylinder dryer having a surface temperature of 100° tc 130° C., and it was then subjected to machine calendering.

COMPARATIVE EXAMPLE 2

The same base paper as produced in Comparative Example 1 was subjected to super calendering.

The base papers as produced in Examples 1 and 2 and Comparative Examples 1 and 2 were coated with a heat-sensitive coating solution. Heat-sensitive recording was performed using the above-prepared heat-sensitive recording sheets, and their recording densities were measured. A method of producing a heat-sensitive coating solution and a method of coating the solution are described hereinafter.

Table 1 shows the properties of the base paper and Table 2 shows the properties of the heat-sensitive recording sheets. The heat-sensitive recording sheets as produced using the base papers as produced in Examples 1 and 2 provide high recording density. Furthermore, these sheets have excellent dot reproducibility compared with the sheets produced using the base papers as produced in Comparative Examples 1 and 2. Sticking occurred with the heat-sensitive recording sheet using the base paper of Comparative Example 2. On the other hand, no sticking occurred with the heat-sensitive recording sheets using the base paper of Examples 1 and 2.

Method for Preparation of Heat-Sensitive Coating Solution

The mixture of 20 kg of Crystal Violet lactone and 100 kg of a 5% aqueous solution of polyvinyl alcohol (degree of saponification: 98% and degree of polymerization: 500) was dispersed in a 300-liter ball mill for about 24 hours. Also, the mixture of 20 kg of 2,2-bis-(4-hydroxyphenyl)propane and 100 kg of a 5% aqueous solution of polyvinyl alcohol was dispersed in a 300-liter ball mill for about 24 hours. These dispersions were mixed in such a manner that the weight ratio of Crystal Violet lactone to 2,2-bis(4-hydroxyphenyl)propane was 1:5. To 20 kg of the resulting mixture was added 5 kg of finely divided calcium carbonate, which was then fully dispersed to prepare a coating solution.

Method of Coating Heat-Sensitive Coating Solution

The coating solution was coated on one surface of the base paper by means of an air knife coater in an amount (solids) of 6 g/m$^2$, and dried in a hot air dryer maintained at 50° C. The sheet was then subjected to machine calendering. In the case of the base papers of Examples 1 and 2, the coating solution was coated on the surface which had been pressed onto the Yankee dryer. On the other hand, in the base papers of Comparative Examples 1 and 2, the coating solution was coated on the felt side.

Recording of Heat-Sensitive Recording Sheet

Entire color formation was performed at a recording speed of 2 milliseconds per dot, a scanning density (in the main scanning direction) of 5 dot/mm, a scanning density (in the side scanning direction) of 6 dot/mm, and a thermal head energy of 50 millijoule/mm$^2$. The recording density was determined by measuring the reflective density at 610 nm.

TABLE 1

(Characteristics of Base Papers)

| Base Paper | Basis Weight (g/m$^2$) | Thickness (μ) | Density (g/cm$^3$) | Optical Contact Ratio (%) | Water Expansion (in cross direction) (%) | Air Permeability/ Basis Weight | Oil Absorption (sec.) | Bekk Smoothness (sec.) |
|---|---|---|---|---|---|---|---|---|
| Example 1 | 51.8 | 70 | 0.74 | 26.1 | 1.40 | 0.25 | 10 | 92 |
| Example 2 | 54.0 | 70 | 0.77 | 37.7 | 1.63 | 0.56 | 19 | 175 |
| Comparative Example 1 | 50.6 | 62 | 0.82 | 4.5 | 4.63 | 0.87 | 24 | 72 |
| Comparative Example 2 | 50.5 | 53 | 0.95 | 21.8 | 4.80 | 2.65 | 380 | 720 |

TABLE 2

(Properties of Heat-Sensitive Recording Sheets)

| Base Paper | Recording Density | Dot reproducibility | Sticking | Water Expansion (in cross direction) (%) | Bekk Smoothness (sec) |
|---|---|---|---|---|---|
| Example 1 | 1.30 | Excellent | None | 1.83 | 180 |
| Example 2 | 1.38 | Excellent | None | 1.98 | 327 |
| Comparative Example 1 | 0.82 | Bad | None | 4.80 | 153 |
| Comparative Example 2 | 0.95 | Good | Observed | 5.04 | 900 |

Note:
(1) In reproducibility of dot, "Excellent" shows that the colored image around the dot is sharp and the dot size is uniform, "Good" shows that the dot size is slightly unevenness, and "No good" shows that the dot not recorded is present.
(2) In sticking, "None" shows that the adhesion of foreign body is not observed on the surface of the recording element and "Observed" shows that adhesion of foreign body is slightly observed.

As is apparent from the results as shown in Table 1, the base papers of Examples 1 and 2 had a low density and a high optical contact ratio, whereas the base paper dried using a multi-cylinder dryer in Comparative Example 1 had a low value on both a density and an optical contact ratio and the base paper of Comparative Example 2 which was prepared by supercalendering the base paper produced in Comparative Example 1 had a high value on both a density and an optical contact ratio.

In the heat-sensitive recording sheets prepared using the above-described base papers, it can be seen from the result as shown in Table 2 that in Examples 1 and 2 the excellent properties in recording density, dot reproducibility and sticking are provided but in Comparative Examples 1 and 2 the above-described all properties are not sufficiently satisfied at the same time.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording sheet, comprising:

a base paper having a density of 0.9 g/cm$^3$ or less; and a heat-sensitive color forming layer coated on the surface of the base paper, the optical contact ratio of the surface of the base paper being at least 15%.

2. A heat-sensitive recording sheet as claimed in claim 1, wherein the base paper is produced by drying a wet web having a water content of 50 to 70% to a water content of 15% or less by pressing the paper onto a Yankee dryer.

3. A heat-sensitive recording sheet as claimed in any of claims 1 or 2, wherein the base paper has a void content of 40% or more.

4. A heat-sensitive recording sheet as claimed in any of claims 1 or 2, wherein the heat-sensitive color forming layer is comprised of dispersed particles having a volume-average particle size of 8 μm or less.

5. A heat-sensitive recording sheet as claimed in claim 4, wherein the particles have a volume-average particle size of 4 μm or less.

6. A heat-sensitive recording sheet as claimed in claim 1, wherein the heat-sensitive color forming layer has a thickness of from 5 to 10 μm.

7. A heat-sensitive recording sheet as claimed in any of claims 1 or 2, wherein the base paper has an optical contact ratio of at least 20%.

8. A heat-sensitive recording sheet as claimed in claim 7, wherein the optical contact ratio of the base paper is at least 25%.

* * * * *